US005175891A

United States Patent [19]

Ohshima et al.

[11] Patent Number: 5,175,891

[45] Date of Patent: Jan. 5, 1993

[54] DEVICE FOR FIXING A TOILET SEAT AND A TOILET LID

[75] Inventors: Kazuyoshi Ohshima; Yojiro Nakayama, both of Tokyo, Japan

[73] Assignee: Sugatsune Industrial Co., Ltd., Tokyo, Japan

[21] Appl. No.: 566,040

[22] Filed: Aug. 13, 1990

[30] Foreign Application Priority Data

Aug. 11, 1989 [JP] Japan ..... 1-95257[U]
Apr. 20, 1990 [JP] Japan ..... 2-42292[U]

[51] Int. Cl.[5] ..... A47K 13/12; E05D 11/10

[52] U.S. Cl. ..... 4/236; 4/240; 403/95; 16/324; 16/333

[58] Field of Search ..... 4/234, 236, 240, 251; 49/394, 402; 248/500; 403/92, 93, 95; 16/223, 297, 277, 321, 324, 333

[56] References Cited

U.S. PATENT DOCUMENTS 4,173,802 11/1979 Wikstrom ..... 4/240 X
4,319,365 3/1982 Bemis et al. ..... 4/240 X
4,426,743 1/1984 Seabrooke ..... 4/251
4,438,535 3/1984 Paredes ..... 4/234
4,688,274 8/1987 Grimstad ..... 4/236
4,729,134 3/1988 Hillebrand et al. ..... 4/236
4,750,238 6/1988 Rock et al. ..... 16/324 X
4,850,080 7/1989 Rock et al. ..... 16/324 X
4,965,889 10/1990 Tissot et al. ..... 4/234
4,974,262 12/1990 Rosen ..... 4/236

*Primary Examiner*—Henry J. Recla
*Assistant Examiner*—Glenn T. Barrett
*Attorney, Agent, or Firm*—Jacobson, Price, Holman & Stern

[57] ABSTRACT

A device for detachably and pivotally connecting a pair of objects such as a toilet seat and lid to a toilet bowl. The device includes a receiving member fixedly mounted on the toilet bowl and a main body connected with the toilet seat and lid. The main body includes a spring biased hook assembly engageable with the receiving member and being manually released from engagement with the receiving member to enable separation of the body and receiving member to thereby enable separation of the toilet seat and lid from the toilet bowl.

1 Claim, 9 Drawing Sheets

DEVICE FOR FIXING A TOILET SEAT AND A TOILET LID

BACKGROUND OF THE INVENTION

1. Field of the Invention

The present invention generally relates to a device for detachably and pivotally connecting a pair of objects such as a toilet seat and lid to a toilet bowl and more specifically to a receiving member fixedly secured to one of the objects and a body connected to the other of the objects combined with a structural arrangement enabling separation of the body and receiving member.

2. Description of Related Art

Previously known devices for connecting a toilet seat and a toilet lid to a toilet bowl include an arrangement in which the toilet bowl has a projection for receiving a horizontal spindle that pivotally supports a toilet seat and a toilet lid. Another well known structure for this purpose is the provision of a pair of vertical bores or apertures in the rim of the toilet bowl for receiving threaded rods or pins projecting downwardly from a hinge which connects a toilet seat and a toilet lid to the toilet bowl.

The arrangement having a projection receiving a horizontal spindle presents considerable difficulty when assembling and disassembling the toilet seat and lid with respect to the toilet bowl and the projection or projections provided on the toilet bowl provide an obstacle when cleaning the toilet bowl. The arrangement utilizing vertical bores or apertures for screw threaded bolts or pins also presents difficulty in assembling and disassembling the toilet seat and lid with respect to the toilet bowl and also presents problems when cleaning and in some instances, the vertical bores do not extend all the way through the toilet bowl and thus can provide areas in which contaminated water may reside. In addition, the use of separate bolts, screws, pins, spindles and the like provide a packaging problem for shipment and transportation and are subject to becoming lost or misplaced. Previously known devices for detachably and pivotally mounted toilet seats and toilet lids to a toilet bowl do not incorporate the features of the present invention.

SUMMARY OF THE INVENTION

An object of the present invention is to provide a device for detachably fixing a toilet seat and a toilet lid to a toilet bowl that enables quick and easy removal for cleaning and quick and easy replacement of the toilet seat and lid with the device being easily packaged for shipment and transportation by eliminating the use of separate connecting components with the device providing a aesthetically pleasing appearance as well as durability and protection against contamination.

Another object of the invention is to provide a device for fixing a toilet seat and toilet lid to a toilet bowl which includes a receiving member fixedly mounted on the toilet bowl and a main body connected with the toilet seat and lid with the receiving member including abutment means including a downwardly inclined upper surface engaged by a corresponding undersurface on the body with means at one end of the body to releasably and pivotally connect one end of the body to the receiving member and the other end of the body including spring biased hook means engageable with the receiving member and being manually released from engagement with the receiving member to enable separation of the body and receiving member thereby enabling separation of the toilet seat and lid from the toilet bowl.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
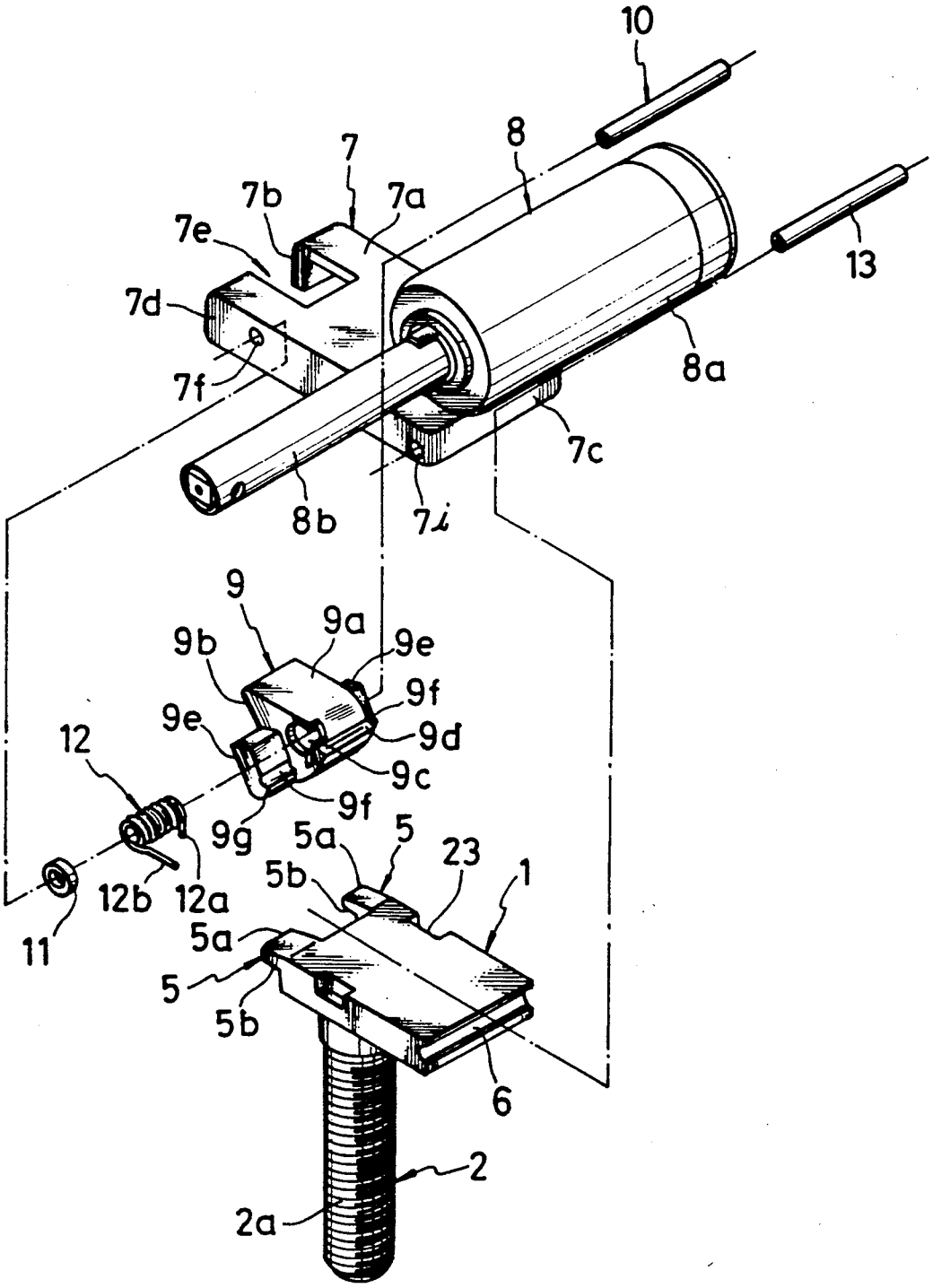
FIG. 1 is an exploded perspective view of one embodiment of the device for fixing a toilet seat and a toilet lid to a toilet bowl illustrating the specific structural features of the invention.

Referring now specifically to FIGS. 1–4 of the drawings, a receiving member 1 in the form of a relatively thick plate constructed of synthetic resin material is provided with a threaded rod 2 projecting perpendicularly and downwardly from the front area of the lower surface of the receiving member 1. The receiving member 1 is rigidly fixed to an upper surface of an object 3 such as a toilet bowl or pan by driving or inserting the threaded rod 2 into a hole or aperture 4 into the object 3 and is tightly anchored to the object 3 without loosening because of the firm engagement between the threads 2*a* formed on the outer periphery of the threaded rod 2 and the thread formed on the inner periphery of the hole or aperture 4. Alternatively, the receiving member 1 may be rigidly fitted to the toilet bowl by means of adhesive thus eliminating the necessity of providing a threaded rod 2.

The receiving member 1 is provided with a pair of abutments 5 at its rear end with each of the abutments 5 having an inclined upper surface 5*a* sloping down from its base area toward the tip and a substantially horizontal abutting surface 5*b* formed on its bottom surface and extending to the tip. On its front side, the receiving member 1 is provided with a horizontal, laterally extending groove 6 for receiving a spindle that forms an axis for swinging movement of a main body 7 in relation to the receiving member 1.

The main body 7 which is removably connected to the receiving member 1 has a top wall 7*a*, a rear side wall 7*b*, a front side wall 7*c* and a pair of lateral side walls 7*d* with all of the side walls being integral with and directly connected to the top wall 7*a*. The main body 7 is inverted U-shaped in configuration and provides a downwardly facing recess which can be stably placed on and received by the receiving member 1.

The main body 7 is provided with a rearwardly and upwardly projecting hinge case or barrel 8*a* forming a hinge 8 with the hinge case 8*a* being integral with the main body 7. The hinge 8 may be an ordinary butt or flap hinge but is preferably, in this embodiment, a dampening hinge comprising a hinge case 8*a* through which a rotatable shaft 8*b* is arranged so that it is rotated with a toilet seat and a toilet lid and the case 8*a* contains viscous fluid within the space between the case 8*a* and the rotatable shaft 8*b* so that the viscous shearing resistance of the viscous fluid and the resilient force of a spring (not shown) provide a resistive force that appropriately dampens any abrupt movement of the tiolet seat and/or toilet lid that may result in the toilet seat and/or toilet lid impacting against the upper edge of the toilet bowl rim.

The main body 7 includes a notch 7*e* formed at the rear end thereof along the longitudinal center line to separate the rear side wall 7*b* and a portion of the top wall 7*a* into two spaced components between which a hook 9 is pivotally supported by a spindle 10 in the form of a hollow pin which supports the hook pivotally so that it can swing vertically around a spindle or shaft 10.

The hook 9 includes a horizontal upper surface 9*a* and an inclined lower surface 9*b* sloping upward from its front end toward the rear end thereby defining a pair of substantially triangular side walls. The hook 9 also includes a horizontal and lateral spindle receiving bore 9*c* oriented near the front end of the hook 9 so that it is pivotally supported by the spindle 10 that extends through the spindle bore 9*c* and supported by a pair of spindle receiving bores 7*f* extending through the lateral side walls 7*d* of the body 7. The spindle 10 is locked against coming out of the bore by means of a pair of lock caps 11.

The hook 9 has an engaging surface 9*d* at its front end for abutting the lower side of the top wall 7*a* of the main body 7 and a pair of trip members 9*e* symmetrically projecting from each of its lateral side walls with the tripping members being provided with tripping surfaces 9*f* removably received by the respective abutting surfaces 5*b* on the receiving member 1. The front sides 9*g* of the tripping members 9*e* on the hook 9 have a curved surface with an appropriate radius of curvature so that they smoothly slide on the respective inclined surfaces 5*a* of the abutments 5 on the receiving member 1.

Figure 2:
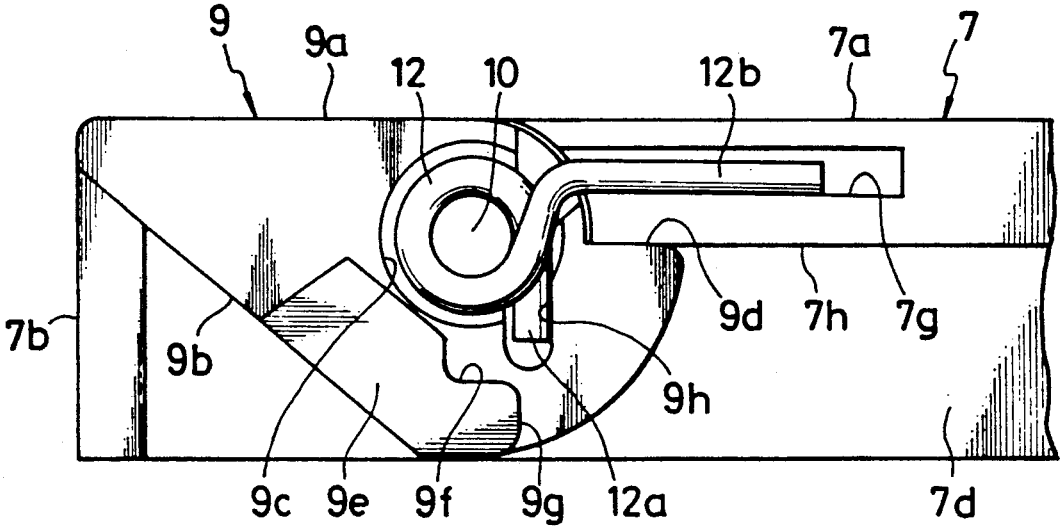
FIG. 2 is an enlarged side view of the structure of FIG. 1 illustrating the device in locked position.
Figure 3:
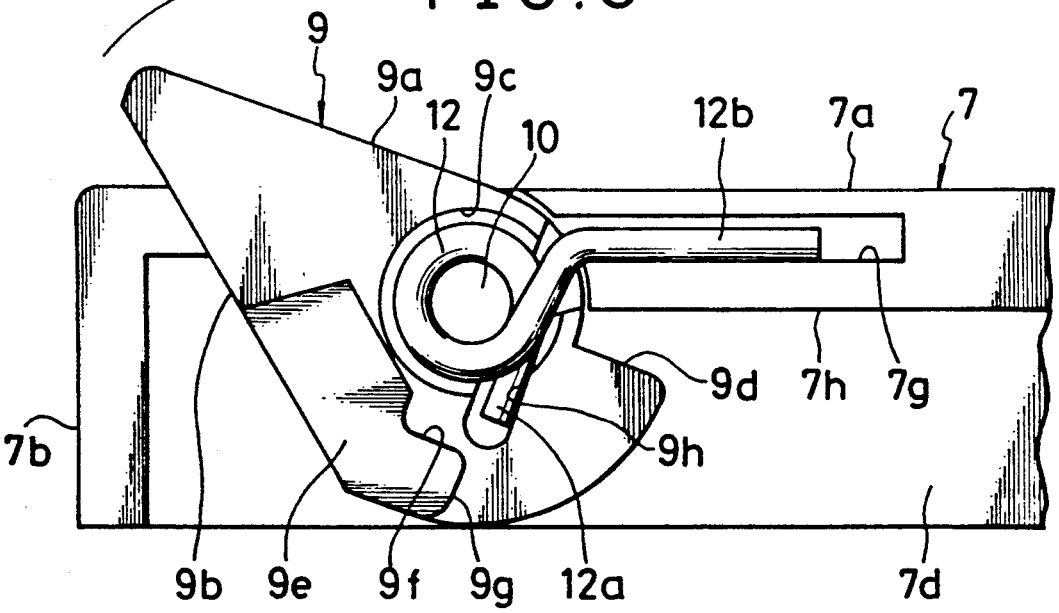
FIG. 3 is an enlarged side view similar to FIG. 2 illustrating the device in unlocked position.
Figure 4A:
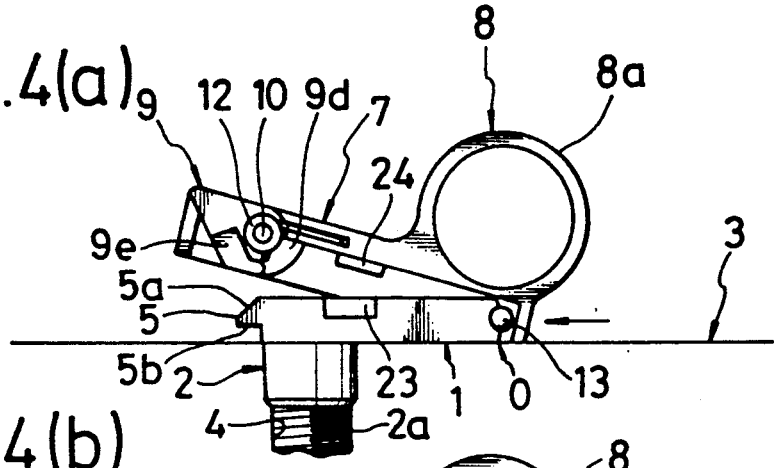
FIGS. 4(*a*), (*b*), (*c*) and (*d*) are sequential side views of the structure of FIG. 1 illustrating how the device is moved to a locked position and then released.
Figure 4B:
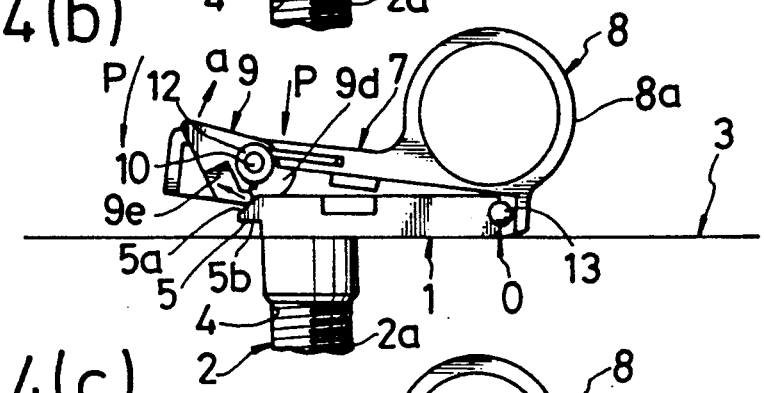
Figure 4C:
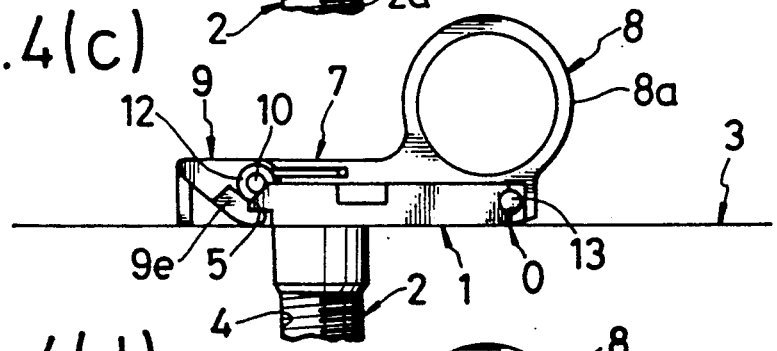
Figure 4D:
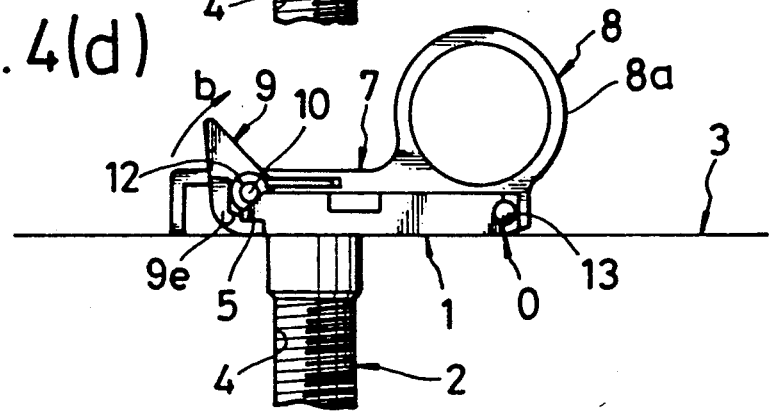

As illustrated in FIG. 2, the hook 9 is supported by the spindle 10 running through the spindle bore 9*c* and is biased counterclockwise by a coil spring 12 having an end 12*a* received by a spring receiver 9*h* in the hook 9 and another end 12*b* received by a spring receiver 7*g* in the main body 7. The surface 9*d* on the hook 9 normally abuts the bottom surface 7*h* of the main body 7 so that the upper surface 9*a* of the hook 9 is held horizontal against the biasing force of the spring 12.

A spindle 13 in the form of a hollow pin is horizontally and laterally arranged at the front area of the main body 7 and is rigidly received by a pair of spindle bores 7*i* through the lateral side wall 7*d* of the main body 7. The spindle 13 provides the axis O of vertical swinging movement of the main body 7 as it is received in the groove 6 in said receiving member 1 as illustrated in FIGS. 4(*a*)–(*d*).

Figure 7:
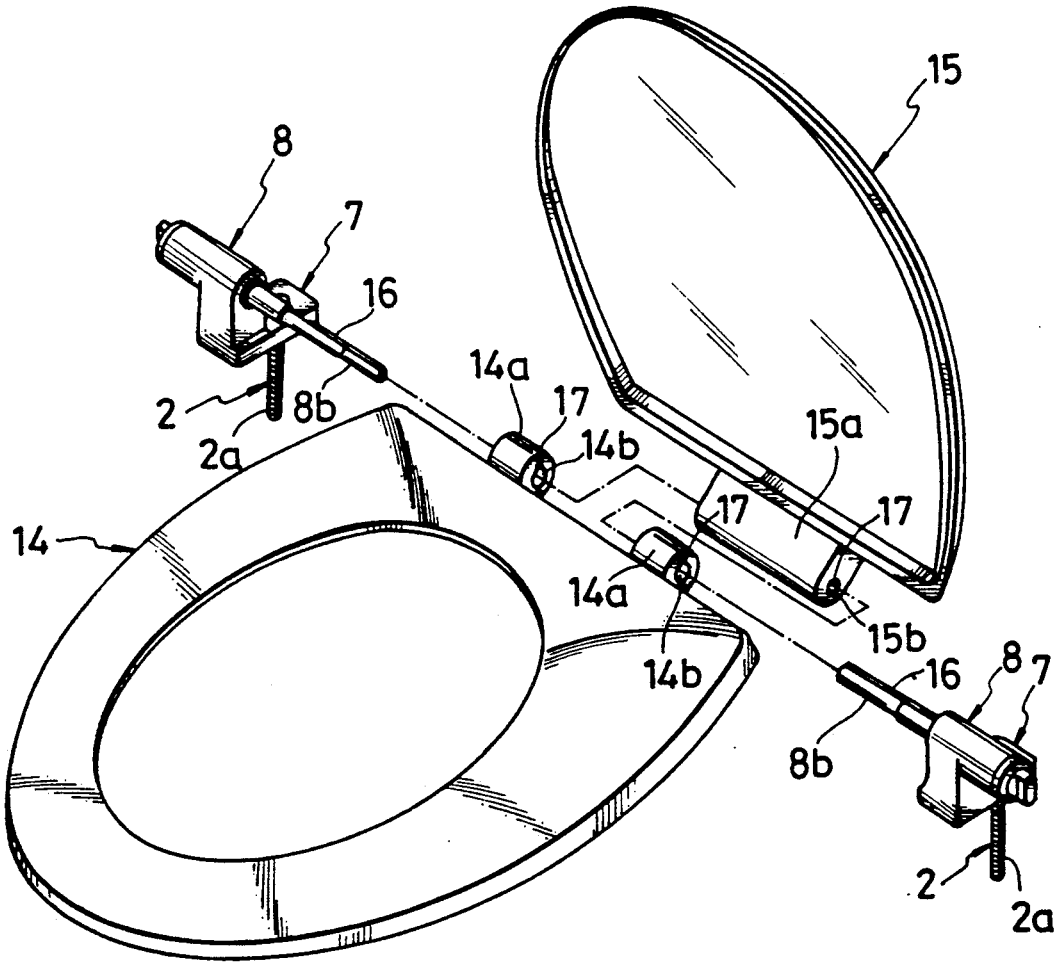
FIG. 7 is an exploded perspective view of the embodiment of the invention illustrated in FIG. 5 showing how the device is used to fix a toilet seat and a toilet lid to a toilet bowl.

As illustrated in FIG. 7, the toilet seat 14 and toilet lid 15 are connected to the toilet bowl 3 by the threaded rod 2 being fitted into the bore or aperture 4 in the toilet bowl 3 with the receiving member 1 rigidly fixed in its proper position on the toilet bowl 3 as illustrated in FIGS. 4(*a*)–(*d*). The movable shaft 8*b* of the hinge 8 is fitted into the shaft receiving and bearing holes or apertures 14*b* and 15*b* extending through respective bosses 14*a* and 15*a* on the toilet seat 14 and the toilet lid 15 respectively and locked in place by means of a key 16 arranged on the movable shaft and a key receiving groove 17 arranged within the shaft receiving holes or apertures 14*b* and 15*b*. Then, both the toilet seat 14 and toilet lid 15 are oriented in a rearwardly inclined position as illustrated in FIG. 4(*a*) by holding by hand the hinge 8 and the main body 7 and the spindle 13 of the main body 7 is fitted into the groove 6 of the receiving member and then the rear end section of the main body 7 is pressed downwardly as indicated by arrow P in FIG. 4(*b*) so that the lower surface of the tripping members 9*e* of the hook 9 abut the respective inclined upper surfaces 5*a* of the abutments 5 to rotate the hook 9 clockwise as indicated by arrow a against the spring force. When the main body 7 is pressed down further, the tripping members 9*e* are rotated further in the direction as indicated by arrow a as they are guided by the respective inclined surfaces 5*a* until they move off the surfaces 5*a* and rotated counterclockwise by the spring force so that the tripping surfaces 9*f* of the tripping members 9*e* and the respective abutting surfaces 5*b* of the abutments 5 come into engagement as illustrated in FIG. 4(*c*). Thus, the toilet seat 14 and the toilet lid 15 are securely fixed to the toilet bowl as the main body 7 is flatly placed on and fixed to the receiving member 1.

In order to remove the toilet seat 14 and the toilet lid 15 from the toilet bowl 3, the hook 9 is lifted upward against the spring force as indicated by arrow b in FIG. 4(*d*) and then rotated counterclockwise to release the engagement of the abutting surfaces 5*b* of the abutments 5 and the respective tripping surfaces 9*f* of the tripping members 9*e* so that the toilet seat 14 and the toilet lid 15 can be removed by lifting the main body 7.

Figure 5:
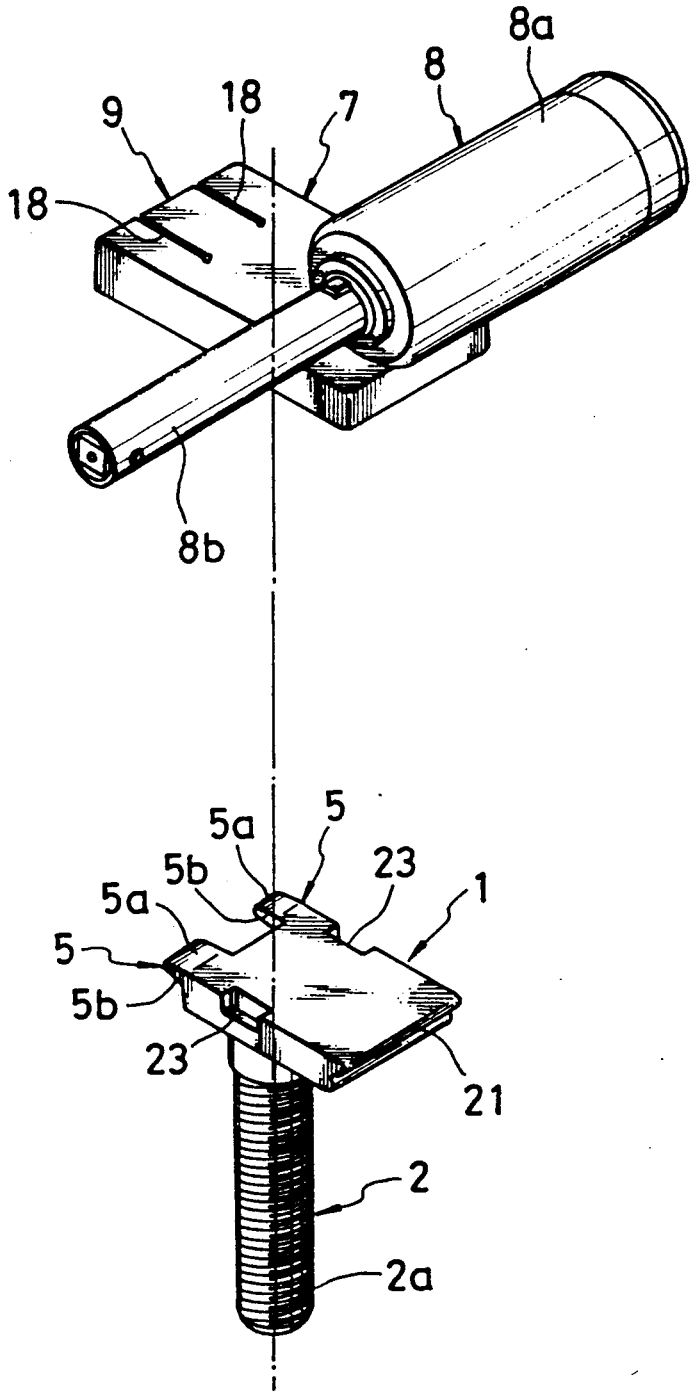
FIG. 5 is an exploded perspective view of a second embodiment of the device of the present invention.
Figure 6A:
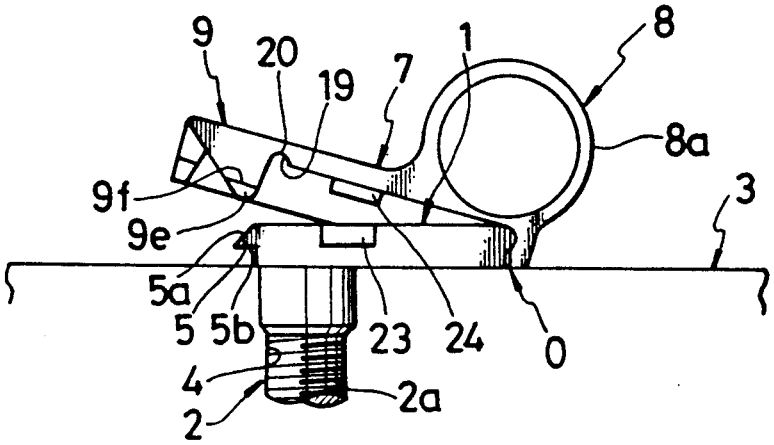
FIGS. 6(*a*) and (*b*) are sequential side views of the structure illustrated in FIG. 5 in unlocked and locked condition.
Figure 6B:
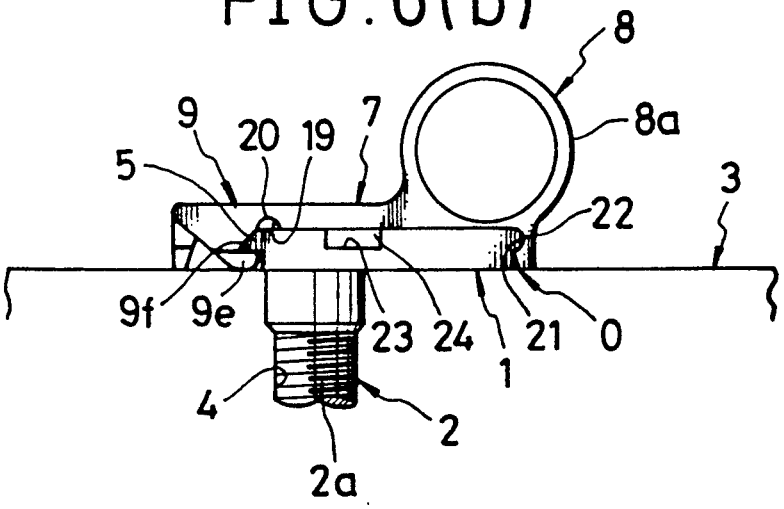

FIG. 5 illustrates the second embodiment of the invention in which the same reference numerals are used for the same components. In this embodiment of the invention, the main body 7 and the hook 9 are of integral one-piece construction and the base section of the hook is resiliently formed so that the main body 7 is locked to the receiving member 1 due to the resilience of the hook 9. The main body 7 is made of elastic material, such as metal, and integrally formed with a hinge case 8*a* of hinge 8 and includes a pair of parallel and longitudinal slits 18 at its rear end to form the hook 9 between the slits which has a lateral groove 19 along its lower base section to form a thin area 20 just above the groove 19 so that the thin area 20 provides a degree of flexibility in order that the hook 9 may be bent upwardly against the resilience of that area as illustrated in FIGS. 6(*a*) and 6(*b*).

Tripping members 9*e* similar to those illustrated in FIGS. 1–5 are arranged on the lower surface of the hook 9 and the axis O of relative rotation between receiving member 1 and the front base section of the main body 7 is formed by a ridge 21 on the receiving member 1 which is removably engaged with a groove 22 in the main body 7. Other than the difference in the hook 9 and the structure which forms pivot axis O, this embodiment is the same as that in FIGS. 1–4 and the main body 7 is mounted to and dismounted from the receiving member 1 in a similar manner.

The receiving member 1 includes a pair of inwardly extending recesses or indentations 23 on the lateral sides thereof and a pair of matching projections 24 are provided on the bottom of the main body 7 which are received in and engaged with the respective indentations 23 to prevent any lateral relative movement between the receiving member 1 and the main body 7 when the main body is fitted onto the receiving member 1.

Figure 8:
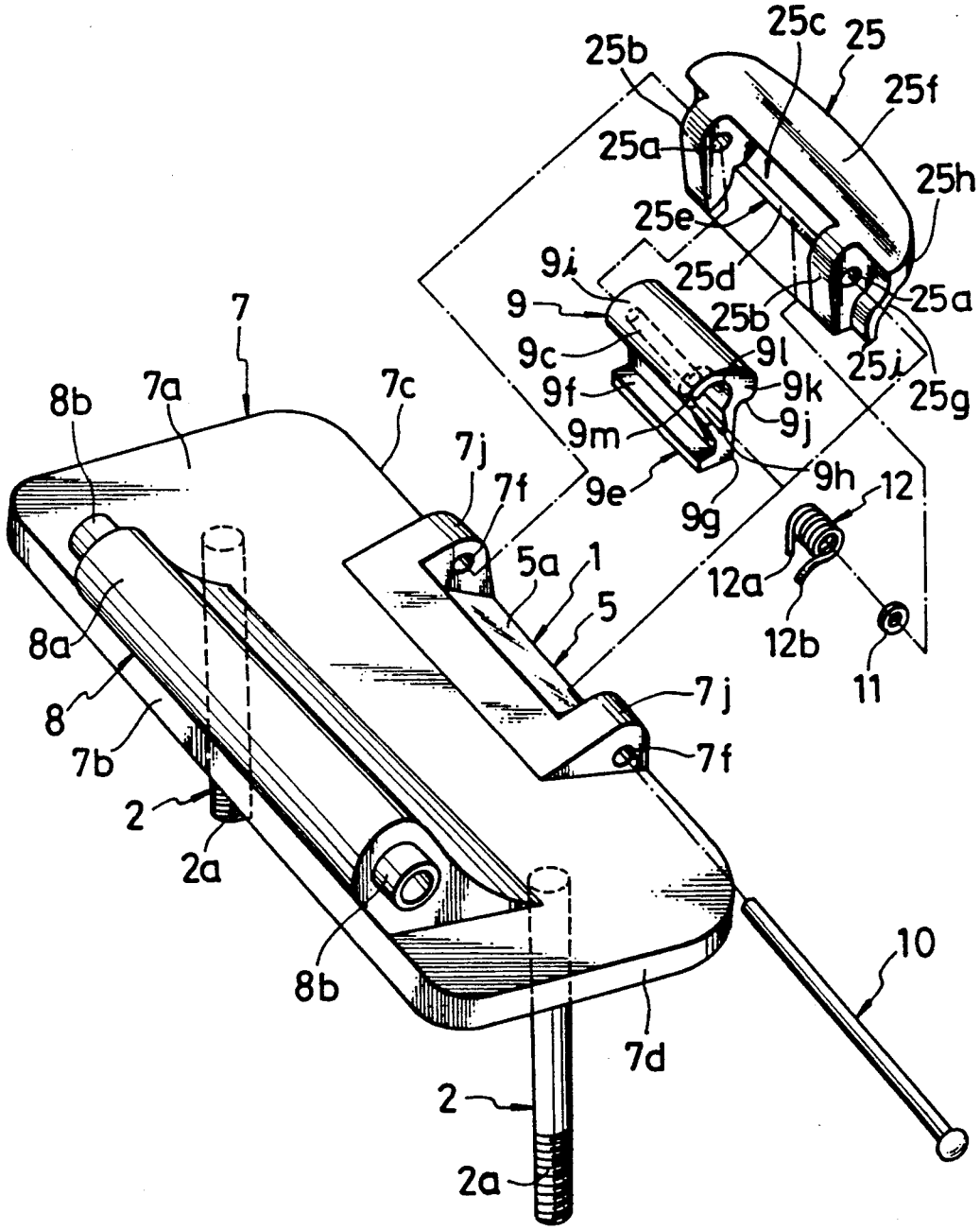
FIG. 8 is an exploded perspective view of a third embodiment of the invention.
Figure 9:
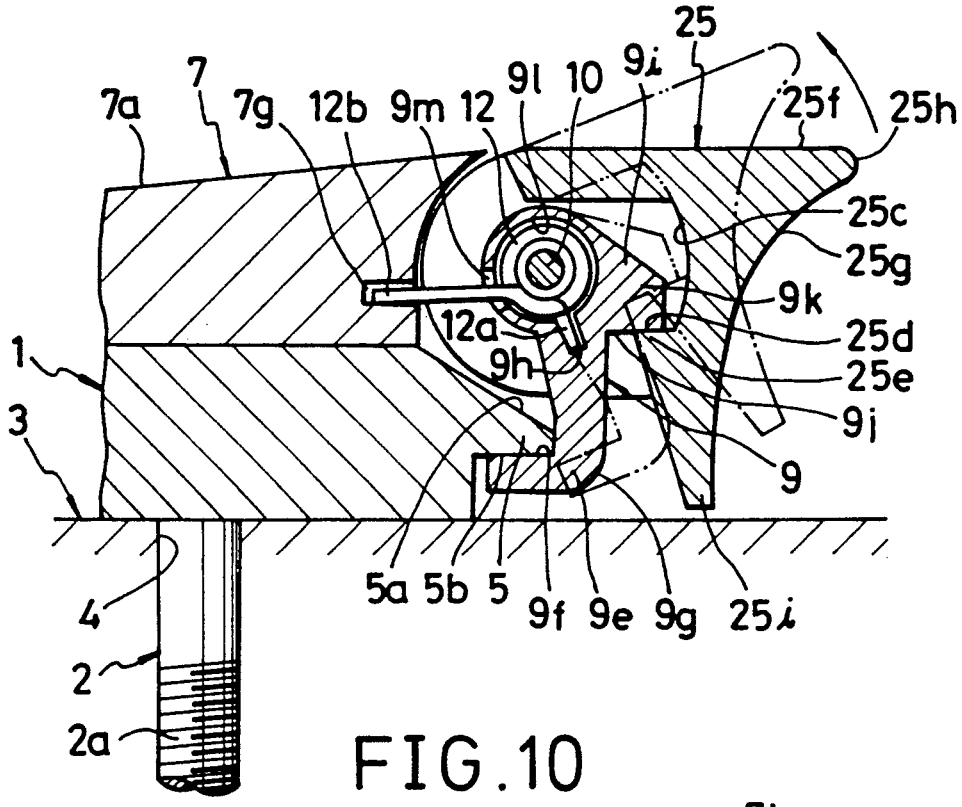
FIG. 9 is a sectional view of the embodiment illustrated in FIG. 8 showing the structure for locking and unlocking the toilet seat and toilet lid to the receiving member secured to the toilet bowl.
Figure 11:
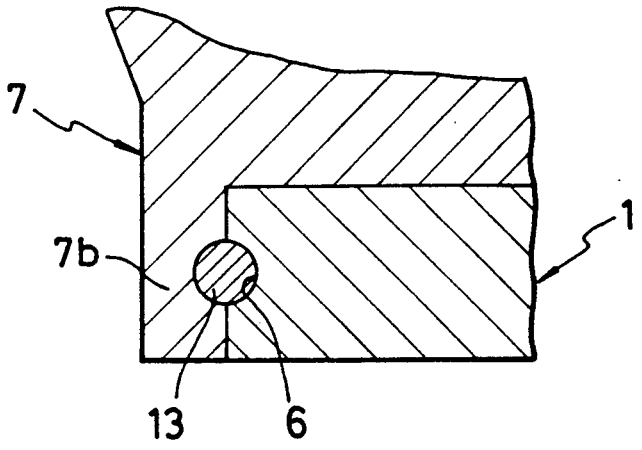
FIG. 11 is a detailed sectional view illustrating the connection between the body and receiving member at the front ends thereof illustrating the axis of rotation of the main body in relation to the receiving member during pivotal movement of the body member in relation to the receiving member during the locking and unlocking procedure.

FIGS. 8, 9 and 11 illustrate another embodiment of the invention in which the same reference numerals are used to indicate the same structure with the configuration of the components being similar to the structure illustrated in FIGS. 1–7. This embodiment includes a plate-like receiving member 1 having a pair of depending threaded rods 2 received in respective fixing holes 4 in the object of fixing such as a toilet bowl 3. An abutment 5 is provided at the center of the rear portion of the receiving member 1 with the abutment 5 having an inclined surface 5*a*, an abutment surface 5*b* and a groove 6 formed on the front edge of the receiving member 1 as illustrated in FIG. 11. Main body 7 is configured substantially similar to the previous embodiments and may be stably and tightly placed on the receiving member 1 and is provided with a hinge including a pair of brackets 7*j* symmetrically arranged at the center of the rear portion of the main body 7 with the brackets being spaced apart. In this embodiment, not only hook 9 but also a lever 25 are supported by a spindle or shaft 10 in the form of a hollow pin that runs through spindle bearings 7*f* in the brackets 7*j* in such a manner that the hook 9 and the lever 25 are vertically swingable about the axis defined by the spindle 10.

The hook 9 comprises a first tripping member 9*e* extending downward from bearing sections 9*i* with an inversely L-shaped cross-section and provided with a tripping surface 9*f* and a second tripping member 9*k* extending rearward from the bearing section 9*f* and provided with a horizontal tripping surface 9*j*. The hook 9 also includes a spindle receiving bore 9*c* and a spring containing cavity 9*l* formed by radially enlarging a part of the spindle bore 9*c* with the spring 12 being fitted around the spindle 10 and contained in the spring containing cavity 9*l* with one of its ends 12*a* supported by a spring holder 9*h* formed by notching a portion of the spring containing cavity 9*l* and its other end extending out of a horizontal groove 9*m* on a portion of the side wall of the spring containing cavity 9*l* and supported by another spring holder 9*g* arranged on the main body 7 in order to downwardly bias the hook 9 (clockwise as illustrated in FIG. 9) with the tripping member 9*e* removably engaging the abutment 5 of the receiving member 1.

In this embodiment, the front side 9*g* of the tripping member 9*e* of the hook 9 has a curved surface with an appropriate radius of curvature so that it will smoothly slide on the inclined surfaces 5*a* of the abutment 5. The spring 12 is retained in position by means of a washer-like cap 11 that is rigidly fixed into the spring containing cavity 9*l*.

The lever 25 is swingably fixed to the main body 7 by the spindle 10 and is provided with a pair of brackets 25*b* having respective spindle bores 25*a* oriented in spaced relation. A horizontal groove 25*c* extends between the brackets 25*b* and faces forward and a tripping section 25*e* with a horizontal and upwardly facing tripping surface 25*d* is formed along the lower edge of the horizontal groove 25*c* so that the second tripping member 9*k* of the hook 9 is received by the tripping member 25*e* when the hook 9 is fitted into the groove 25*c*. The hook 9 is upwardly swingable against the spring force of the spring 12 by means of the lever 25. The groove 25*c* is sized so that the second tripping member 9*k* of the hook 9 is vertically swingable without friction when the main body 7 is fitted to the receiving member 1.

The lever 25 has a horizontal upper surface 25*f* and an inwardly curved rear surface 25*g* so that it has a substantially triangular side configuration with a finger grip being formed by the convergence of the upper surface 25*h* and the curved rear surface 25*g* and extending rearwardly and upwardly with a rear wall 25*i* covering the hook 9 to conceal it.

FIG. 11 illustrates the spindle 13 at the front area of the main body 7 which extends from the lateral sides 7*d* of the main body 7 to provide an axis of vertical swinging motion of the main body 7 when the spindle 13 is fitted into the horizontal groove 6 at the front of the receiving member thereby removably fitting the main body 7 to the receiving member 1.

Figure 10:
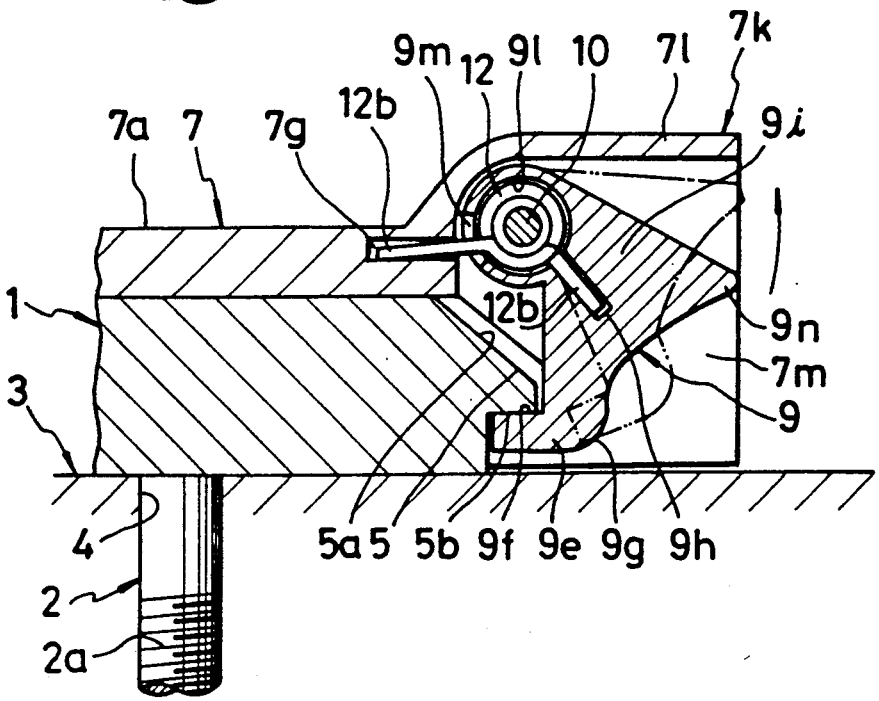
FIG. 10 is a sectional view of a fourth embodiment of the invention in locked position and illustrating an unlocked position by broken lines.

FIG. 10 illustrates the fourth embodiment of the present invention in which a hook actuating section 9*n* is formed by extending a member that corresponds to the second tripping member 9*k* of the hook 9 illustrated in FIG. 9. In this embodiment, main body 7 has a projecting cover section 7*k* extending rearward from its rear end with the section 7*k* including an inverted U-shaped cross-sectional configuration formed by its horizontal top wall 71 which covers the upper and lateral areas of the hook 9 and a pair of lateral walls 7*m* which project downwardly from the lateral edges of the top wall 7*l* and define a rear opening. In this construction, the hook 9 can be rotated upward against the spring force of spring 12 to release the engagement between the tripping member 9*e* and the abutment 5 of the receiving member 1 by holding the top wall 7*l* and the hook actuating section 9*n* rearwardly extending from the bearing section 9*a* with a thumb and forefinger and squeezing these components together thus pivoting the hook 9 in FIG. 10 in a counterclockwise direction to release the hook 9 from the abutment 5. Otherwise, this structure operates in the same manner as the other embodiments of the invention.

The above invention provides a device which can be used for removably connecting or fixing a toilet seat and a toilet lid to a toilet bowl or pan by simply bringing the main body and the receiving member into engagement at their base sections to provide an axis of rotation and then pressing down the front end of the main body relative to the receiving member around the axis and rotating the front end of the hook so that the toilet bowl, toilet seat and toilet lid can be serviced and maintained without difficulty. This device enables both the toilet seat and the toilet lid to be easily removed for cleaning. Since the hinge of the device is free of screws and protrusions, a toilet bowl equipped with this device can be shipped after assembly with the toilet seat or the toilet lid being replaceable without difficulty whenever it is damaged or replacement is desired. The various embodiments of the invention enable assembly and disassembly without the manipulation of fastening devices such as nuts, bolts, screws and the like. Also, the invention enhances the safety of individuals engaged in the assembly and disassembly of toilet seats and toilet lids in relation to a toilet bowl since it reduces the risk of pinched fingers during the fixing or removing operation. Further, the invention provides an improved appearance and protection against dirt and contamination with operation of the hook being relatively easy to enable individuals without exceptional skill or strength to remove and replace toilet seats and toilet lids when desired.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A device for detachably connecting a pair of objects comprising a receiving member adapted to be fixedly secured to one of said objects, said receiving member having abutment means at one end, said abutment means including a downwardly inclined upper surface area extending to an outer edge thereof and a downwardly facing surface area on an undersurface thereof in opposed relation to the inclined upper surface area, a body adapted to be connected with the other of said objects, said body having an undersurface engaged with an upper surface of said receiving member, means at one end of said body to releasably and pivotally connect one end of said body to the receiving member in spaced opposed relation to the abutment means, the other end of said body including spring biased hook means engageable with said inclined surface area when the other end of said body is moved toward the receiving member with the inclined surface area camming the hook means outwardly against the spring bias to enable the hook means to move down past the outer edge of the receiving member and engage the undersurface of the abutment means to secure the body to the receiving member, said hook means including means enabling manual release of the hook means from engagement with the undersurface of the receiving member to enable separation of the body from the receiving member, said hook means including a hook vertically swingably supported at said other end of said body by means of a spindle, a spring biasing said hook into locking engagement with the downwardly facing surface area on said receiving member, said spring forming the sole means retaining the hook engaged with the downwardly facing surface area, said hook being provided with a hook actuating section disposed for engagement to pivot the hook to a position to release the hook from engagement with said abutment means on the receiving member and forming said means to release the hook means, and a lever pivotally supported from said body by the spindle which supports the hook from the body, said hook actuating section of the hook including a downwardly facing tripping surface on the hook actuating section, said lever including an upwardly facing tripping section engaged with the downwardly facing tripping surface on the hook actuating section, said lever including a curved rear surface to form a finger gripping area to enable the lever and hook to be pivoted about the spindle to move the hook away from the downwardly facing surface area on said receiving member to enable pivotal movement of the body in relation to the receiving member about the pivotal connecting means at one end of said body.

* * * * *